US011626053B2

(12) United States Patent
Nam

(10) Patent No.: US 11,626,053 B2
(45) **Date of Patent: *Apr. 11, 2023**

(54) DISPLAY DEVICE

(71) Applicant: Samsung Display Co., Ltd., Yongin-Si (KR)

(72) Inventor: Yanguk Nam, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/669,862

(22) Filed: Feb. 11, 2022

(65) Prior Publication Data

US 2022/0165196 A1 May 26, 2022

Related U.S. Application Data

(63) Continuation of application No. 17/154,943, filed on Jan. 21, 2021, now Pat. No. 11,250,757.

(30) Foreign Application Priority Data

Mar. 2, 2020 (KR) ..... 10-2020-0026014

(51) Int. Cl.
*G09G 3/20* (2006.01)

(52) U.S. Cl.
CPC ..... *G09G 3/20* (2013.01); *G09G 2310/08* (2013.01); *G09G 2330/021* (2013.01);
(Continued)

(58) Field of Classification Search
CPC ..... G09G 3/20; G09G 2300/08; G09G 2310/061; G09G 2310/08;
(Continued)

(56) References Cited

U.S. PATENT DOCUMENTS 6,067,645 A 5/2000 Yamamoto et al.
2014/0168047 A1 6/2014 Kim et al.
(Continued)

FOREIGN PATENT DOCUMENTS

KR 10-0193737 B1 6/1999

OTHER PUBLICATIONS

Ronald Rivest, Deacon Vorbis, "MD5 message-digest algorithm", Journals or serial, Feb. 29, 2020, 12 pages, MD5—Wikipedia, U.S., https://en.wikipedia.org/w/index.php?title=MD5&oldid=943217009.

*Primary Examiner* — Gerald Johnson
(74) *Attorney, Agent, or Firm* — Innovation Counsel LLP

(57) ABSTRACT

A display device includes a display panel, a display panel driving circuit, and a power management integrated circuit that generates driving voltages, receives driving set data from a timing controller, stores driving hex values corresponding to the driving set data in first internal registers, and determines voltage levels of the driving voltages based on the driving hex values. The power management integrated circuit divides the driving hex values into upper and lower decimal values, derives a result decimal value by applying the upper and lower decimal values to a first authentication-formula, generates a result hex value based on the result decimal value, compares an authentication hex value corresponding to authentication data received from the timing controller with the result hex value, and selectively operates in a normal mode or in a protection mode based on a comparison result between the authentication hex value and the result hex value.

30 Claims, 8 Drawing Sheets

| REGISTER ADDRESS | HEX | UDV | LDV |
|---|---|---|---|
| 00h | E1→E5 | 14 | 1→5 |
| 01h | EF | 14 | 15 |
| 02h | EF | 14 | 15 |
| 03h | 66 | 6 | 6 |
| 04h | 6E | 6 | 14 |
| 05h | 36 | 3 | 6 |
| 06h | 88 | 8 | 8 |
| 07h | 87 | 8 | 7 |
| 08h | 1E→AE | 1→10 | 14 |

(52) U.S. Cl.
CPC ..... *G09G 2330/04* (2013.01); *G09G 2358/00* (2013.01); *G09G 2370/00* (2013.01)

(58) Field of Classification Search
CPC ..... G09G 2330/021; G09G 2330/04; G09G 2358/00; G09G 2370/00
See application file for complete search history.

(56) References Cited

U.S. PATENT DOCUMENTS

| | | | | |
|---|---|---|---|---|
| 2016/0063918 | A1* | 3/2016 | Choi | G09G 3/3233 345/55 |
| 2018/0059470 | A1 | 3/2018 | Nam et al. | |
| 2018/0158397 | A1 | 6/2018 | Nam et al. | |
| 2018/0196301 | A1 | 7/2018 | Choi et al. | |
| 2022/0197467 | A1* | 6/2022 | Kim | G06F 3/0443 |

* cited by examiner

FIG. 7A

| REGISTER ADDRESS | HEX | UDV | LDV |
|---|---|---|---|
| 00h | E1 | 14 | 1 |
| 01h | EF | 14 | 15 |
| 02h | EF | 14 | 15 |
| 03h | 66 | 6 | 6 |
| 04h | 6E | 6 | 14 |
| 05h | 36 | 3 | 6 |
| 06h | 88 | 8 | 8 |
| 07h | 87 | 8 | 7 |
| 08h | 1E | 1 | 14 |

FIG. 7B

| REGISTER ADDRESS | HEX | UDV | LDV |
|---|---|---|---|
| 00h | E1→E5 | 14 | 1→5 |
| 01h | EF | 14 | 15 |
| 02h | EF | 14 | 15 |
| 03h | 66 | 6 | 6 |
| 04h | 6E | 6 | 14 |
| 05h | 36 | 3 | 6 |
| 06h | 88 | 8 | 8 |
| 07h | 87 | 8 | 7 |
| 08h | 1E→AE | 1→10 | 14 |

FIG. 8A

| REGISTER ADDRESS | HEX | UDV | LDV |
|---|---|---|---|
| 00h | E1 | 14 | 1 |
| 01h | EF | 14 | 15 |
| 02h | EF | 14 | 15 |
| 03h | 66 | 6 | 6 |
| 04h | 6E | 6 | 14 |
| 05h | 36 | 3 | 6 |
| 06h | 88 | 8 | 8 |
| 07h | 87 | 8 | 7 |
| 08h | 1E | 1 | 14 |

FIG. 8B

| REGISTER ADDRESS | HEX | UDV | LDV |
|---|---|---|---|
| 00h | E1→E5 | 14 | 1→5 |
| 01h | EF | 14 | 15 |
| 02h | EF | 14 | 15 |
| 03h | 66 | 6 | 6 |
| 04h | 6E | 6 | 14 |
| 05h | 36 | 3 | 6 |
| 06h | 88 | 8 | 8 |
| 07h | 87 | 8 | 7 |
| 08h | 1E→AE(OK)<br>1E→FE(ERROR) | 1→10(OK)<br>1→15(ERROR) | 14 |

DISPLAY DEVICE

CROSS-REFERENCE TO RELATED APPLICATION

This application is a continuation application of U.S. patent application Ser. No. 17/154,943 filed on Jan. 21, 2021, which claims priority under 35 USC § 119 to Korean Patent Application No. 10-2020-0026014 filed on Mar. 2, 2020 in the Korean Intellectual Property Office (KIPO), the disclosure of which is incorporated by reference in its entirety.

BACKGROUND

1. Field

The present disclosure relates generally to a display device. More particularly, the present disclosure relates to a display device that can change operating conditions by a communication between a timing controller and a power management integrated circuit.

2. Description of the Related Art

Generally, a display device includes a display panel, a display panel driving circuit including a scan driver, a data driver, a timing controller, ortho like that drives the display panel, and a power management integrated circuit that generates driving voltages for driving the display panel and the display panel driving circuit. The timing controller and the power management integrated circuit may communicate with each other to change an operating condition (e.g., change of levels of the driving voltages for driving the display panel and the display panel driving circuit).

An $I^2C$ communication that supports a simple connection between hardware devices is widely used due to its simplicity of having an SDA line for transferring a data signal and an SCL line for transferring a clock signal. Usually, performance of the power management integrated circuit is determined by the efficiency of performing an operating condition change. Thus, a manufacturer of the power management integrated circuit tries to keep their technologies for performing the operating condition change or the like from being leaked to other manufacturers.

The power management integrated circuit may be designed to operate under various operating conditions using the $I^2C$ communication after connecting to a display panel and a display panel driving circuit. The specifications of the display panel and/or the display panel driving circuit may be identified to the power management integrated circuit, and one may easily investigate and understand a proprietary technology of the power management integrated circuit for performing the operating condition change or the like after connecting to the display panel and/or the display panel driving circuit. As a result, there is a problem that the proprietary technology (e.g., intellectual property) of a manufacturer of a specific power management integrated circuit can be leaked to other manufacturers.

SUMMARY

The present disclosure provides a display device capable of selectively operating a power management integrated circuit in a normal mode (e.g., a high performance mode) or in a protection mode (e.g., a limited performance mode or a shut-down mode). The power management integrated circuit may perform a specific communication (e.g., an $I^2C$ communication) with the timing controller to authenticate a change of operating conditions, for example, change of levels of driving voltages for driving the display panel and the display panel driving circuit.

According to one embodiment, a display device may include a display panel, a display panel driving circuit including a timing controller and configured to drive the display panel, and a power management integrated circuit configured to generate a plurality of driving voltages for driving the display panel and the display panel driving circuit, receive driving set data from the timing controller, store driving hex values corresponding to the driving set data in first internal registers, and determine voltage levels of the plurality of driving voltages based on the driving hex values. The power management integrated circuit may divide the driving hex values into upper decimal values and lower decimal values, derive a result decimal value by applying the upper decimal values and the lower decimal values to a first authentication formula, generate a result hex value based on the result decimal value, compare an authentication hex value corresponding to authentication data received from the timing controller with the result hex value, and selectively operate in a normal mode or in a protection mode based on a comparison result between the authentication hex value and the result hex value.

In an embodiment, the power management integrated circuit may operate in the normal mode if the authentication hex value is consistent with the result hex value and operate in the protection mode if the authentication hex value is inconsistent with the result hex value.

In an embodiment, the power management integrated circuit may operate in the normal mode if the authentication hex value is consistent with the result hex value and operate in the protection mode if the authentication hex value is not received from the timing controller within a preset time.

In an embodiment, if first driving set data that are determined in a first image frame is different from second driving set data that are determined in a second image frame following the first image frame, an authentication operation may be performed between the timing controller and the power management integrated circuit during the second image frame.

In an embodiment, the timing controller and the power management integrated circuit may perform an inter integrated circuit (PC) communication for performing the authentication operation. In addition, the timing controller may provide at least one updated driving set data among the driving set data that is changed from the first driving set data to the second driving set data to the power management integrated circuit and provide the authentication data to the power management integrated circuit during the second image frame.

In an embodiment, the timing controller may determine the driving set data based on image data input in each image frame, store the driving hex values corresponding to the driving set data in second internal registers, and transmit the driving set data to the power management integrated circuit.

In an embodiment, the timing controller may compare first driving set data that are determined in a first image frame with second driving set data that are determined in a second image frame following the first image frame. In addition, the timing controller may update at least one updated driving set data among the driving set data that is changedfrom the first driving set data to the second driving set data in the second internal registers and transmit the at least one updated driving set data to the power management integrated circuit during the second image frame.

In an embodiment, the power management integrated circuit may update the at least one updated driving set data received from the timing controller in the first internal registers during the second image frame.

In an embodiment, the timing controller may divide the driving hex values into the upper decimal values and the lower decimal values, derive an authentication decimal value by applying the upper decimal values and the lower decimal values to a second authentication formula, generate the authentication hex value based on the authentication decimal value, and transmit the authentication hex value to the power management integrated circuit.

In an embodiment, the upper decimal values and the lower decimal values may be used as variables in the first authentication formula.

In an embodiment, the power management integrated circuit may have an exclusive access to the first authentication formulathat the timing controller may not have.

In an embodiment, the upper decimal values and the lower decimal values may be used as variables in the second authentication formula.

In an embodiment, the timing controller may have an exclusive access to the second authentication formula that the power management integrated circuit may not have.

In an embodiment, the authentication hex value may be consistent with the result hex value if the first authentication formula is same as the second authentication formula, and the authentication hex value may not inconsistent with the result hex value if the first authentication formula is different from the second authentication formula.

In an embodiment, the power management integrated circuit may further include a first authentication register for storing the result hex value, and a first size of the first authentication register may be half of a second size of each of the first internal registers.

In an embodiment, the timing controller may further include a second authentication register for storing the authentication hex value, and a third size of the second authentication register may be half of a fourth size of each of the second internal registers.

In an embodiment, the first authentication register may be stored in a first portion of at least one of the first internal registers, and the second authentication register may be stored in a second portion of at least one of the second internal registers.

In an embodiment, the power management integrated circuit may operate at high-performance based on the power management integrated circuit operating in the normal mode.

In an embodiment, the power management integrated circuit may operate at limited performance lower than the high performance in the protection mode.

In an embodiment, the power management integrated circuit may be shut down in the protection mode.

The display device disclosed herein may selectively operate the power management integrated circuit in a normal mode (e.g., a high performance mode) or in a protection mode (e.g., a limited performance mode or a shut-down mode) based on an authentication between the timing controller and the power management integrated circuit via a specific communication to change operating conditions (e.g., voltage levels of driving voltages for driving a display panel and a display panel driving circuit). The power management integrated circuit generates the driving voltages, receives driving set data from the timing controller included in the display panel driving circuit, stores driving hex values corresponding to the driving set data in first internal registers, and determines the operating conditions based on the driving hex values. The power management integrated circuit divides the driving hex values into upper decimal values and lower decimal values, derives a result decimal value by applying the upper decimal values and the lower decimal values to a first authentication formula, generates a result hex value based on the result decimal value, compares an authentication hex value corresponding to authentication data received from the timing controller with the result hex value, and selectively operates in the normal mode or in the protection mode based on a comparison result between the authentication hex value and the result hex value. As a result, when a display panel and/or a display panel driving circuit are connected to the power management integrated circuit, the power management integrated circuit may not operate in the normal mode if the authentication between the timing controller and the power management integrated circuit fails, so that a proprietary technology applied to the power management integrated circuit by a manufacturer of the power management integrated circuit may be prevented from being leaked to other manufacturers. However, the effects of the present inventive concept are not limited thereto. It is understood that the present inventive concept may be extended without departing from the spirit and the scope of the present disclosure.

BRIEF DESCRIPTION OF THE DRAWINGS

Illustrative, non-limiting embodiments of the present disclosure will be more clearly understood from the following detailed description in conjunction with the accompanying drawings.

FIGS. 7A and 7B illustrate examples for describing an operation of the power management integrated circuit as a part of an authentication operation performed between the timing controller and the power management integrated circuit in the display device of FIG. 1.

FIGS. 8A and 8B illustrate examples for describing an operation of the timing controller as a part of an authentication operation performed between the timing controller and the power management integrated circuit in the display device of FIG. 1.

DETAILED DESCRIPTION OF THE EMBODIMENTS

Hereinafter, embodiments of the present disclosure will be explained in detail with reference to the accompanying drawings.

Figure 1:
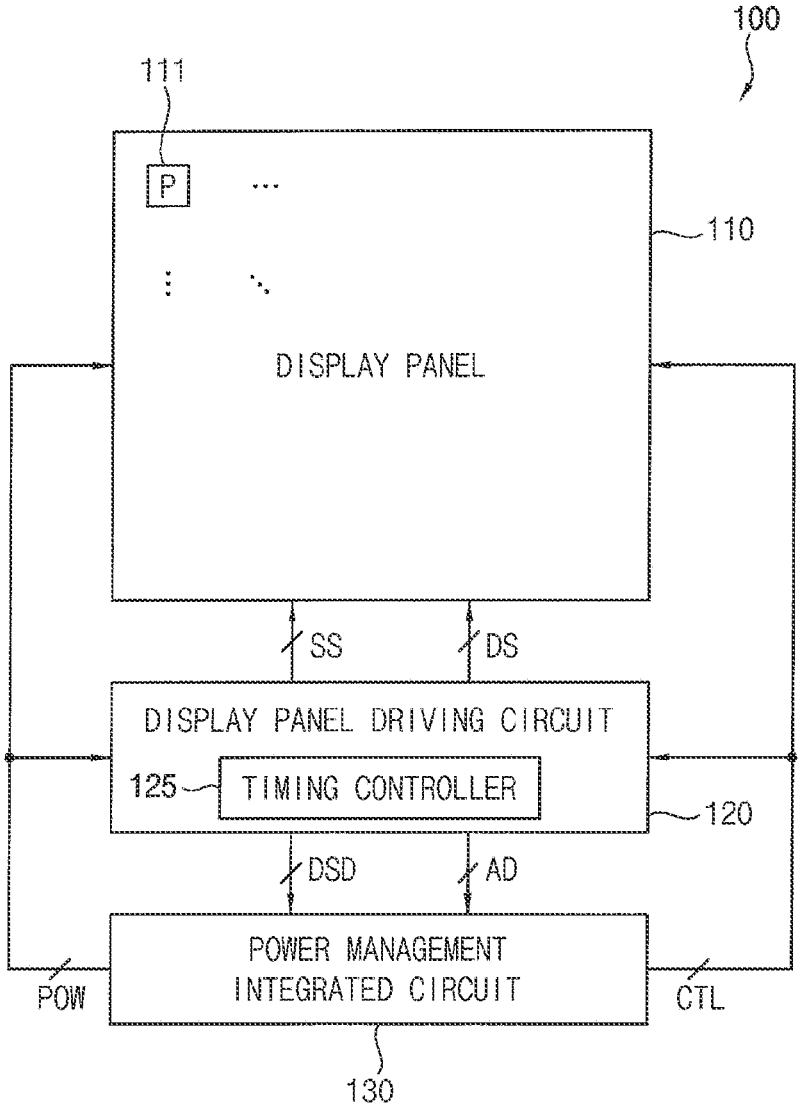
FIG. 1 is a block diagram illustrating a display device according to an embodiment.
Figure 2:
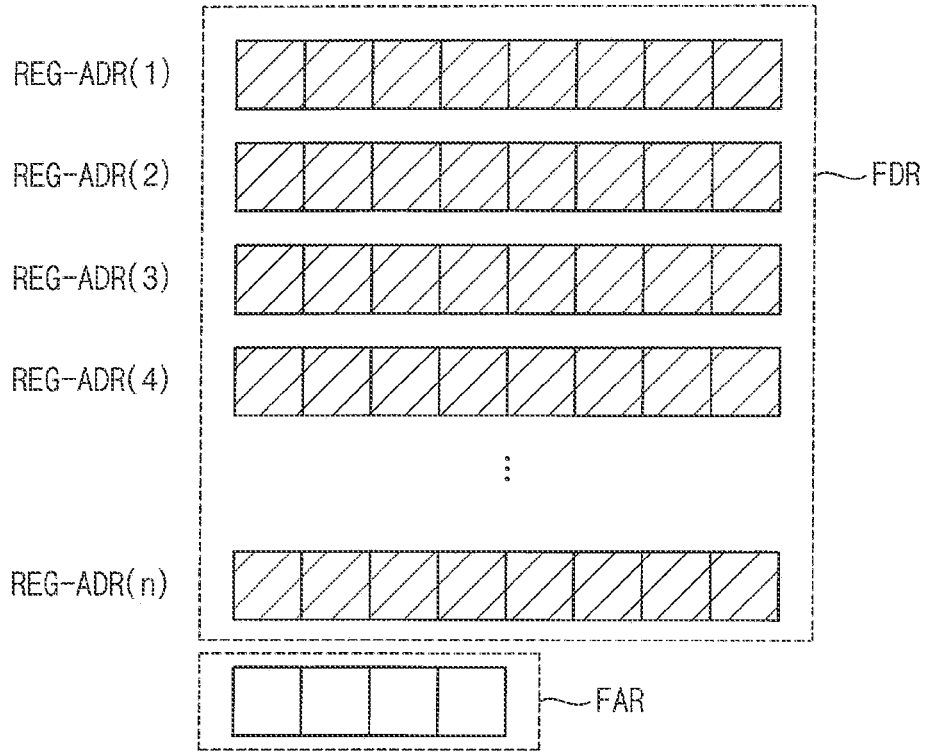
FIG. 2 illustrates an example of first internal registers and a first authentication register included in a power management integrated circuit of the display device of FIG. 1.
Figure 3:
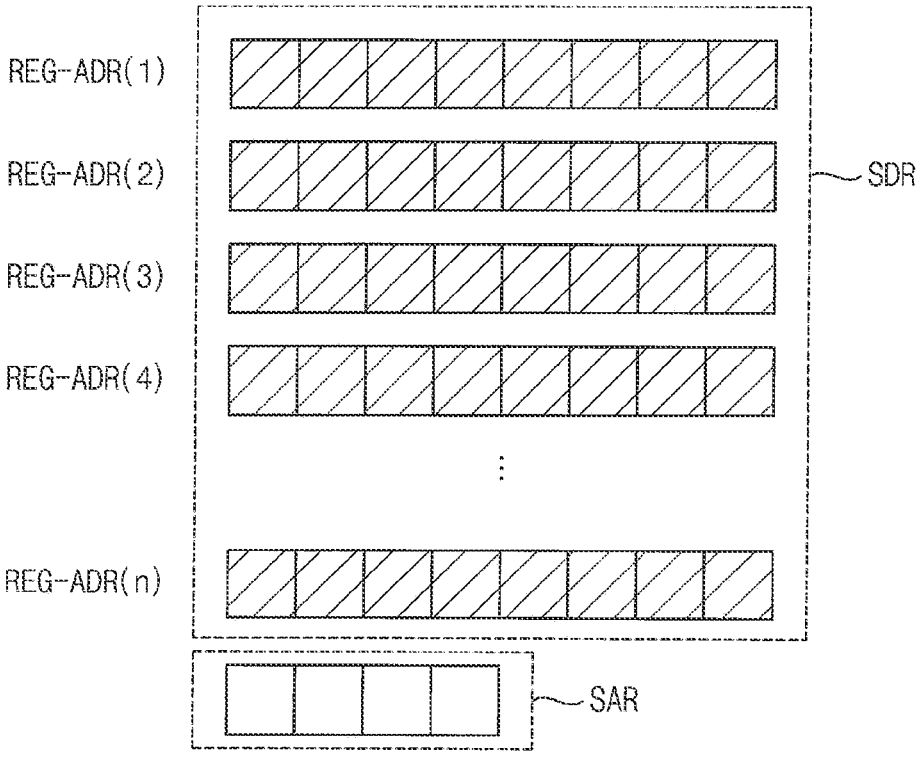
FIG. 3 illustrates an example of second internal registers and a second authentication register included in a timing controller of the display device of FIG. 1.

FIG. 1 is a block diagram illustrating a display device according to an embodiment, FIG. 2 illustrates an example of first internal registers and a first authentication register included in a power management integrated circuit of the display device of FIG. 1, and FIG. 3 illustrates an example of second internal registers and a second authentication register included in a timing controller of the display device of FIG. 1.

Referring to FIGS. 1 to 3, a display device 100 may include a display panel 110, a display panel driving circuit 120, and a power management integrated circuit 130. In some embodiments, the display device 100 may be an organic light emitting display device or a liquid crystal display device. However, the display device 100 is not limited thereto, and it is understood that the display device 100 may be different types of display devices without deviating from the scope of the present disclosure.

The display panel 110 may include a plurality of pixels 111. The pixels 111 may be arranged in various configurations (e.g., a matrix) in the display panel 110. Each of the pixels 111 may correspond to at least one of a red displaying pixel, a green displaying pixel, and a blue displaying pixel. The display panel driving circuit 120 may drive the display panel 110. The display panel driving circuit 120 may include a scan driver (not shown), a data driver (not shown), and a timing controller 125. The scan driver may be electrically connected to the display panel 110 via scan lines and provide a scan signal SS to the pixels 111 of the display panel 110 via the scan lines. The data driver may be electrically connected to the display panel 110 via data lines and provide a data signal DS to the pixels 111 of the display panel 110 via the data lines. The timing controller 125 may control the scan driver and the data driver. In addition, the timing controller 125 may perform a specific processing (e.g., a deterioration compensation processing) on image data that is input from an external component. In some embodiments, the timing controller 125 may perform a specific communication (e.g., an $I^2C$ communication) with the power management integrated circuit 130 to change operating conditions. For example, the timing controller 125 may communicate with the power management integrated circuit 130 to control the power management integrated circuit 130 to change voltage levels of driving voltages (e.g., a high power voltage ELVDD, a low power voltage ELVSS, and an analog high voltage AVDD) for driving the display panel 110 and the display panel driving circuit 120. Hereinafter, the high power voltage ELVDD, the low power voltage ELVSS, and the analog high voltage AVDD may be collectively referred to as driving voltages. In another example, the timing controller 125 may communicate with the power management integrated circuit 130 to control the power management integrated circuit 130 to perform a specific operation for the display panel 110 and the display panel driving circuit 120.

The power management integrated circuit 130 may generate a plurality of driving voltages denoted as POW for driving the display panel 110 and the display panel driving circuit 120, receive driving set data DSD from the timing controller 125 included in the display panel driving circuit 120, store driving hex values corresponding to the driving set data DSD in first internal registers FDR, and determine operating conditions including the voltage levels of the driving voltages based on the driving hex values denoted as CTL. As illustrated in FIG. 2, the driving hex values may be expressed by 8 bits, and each of the first internal registers FDR for storing the driving hex value may have a storage space of 8 bits. For example, a first driving hex value may be stored in a first register address REG-ADR(1) of the first internal register FDR, a second driving hex value may be stored in a second register address REG-ADR(2) of the first internal register FDR, and an n-th driving hex value may be stored in an n-th register address REG-ADR(n) of the first internal register FDR, where n is an integer equal to or greater than 2. Here, all (e.g., upper 4 bits and lower 4 bits) or a portion (e.g., upper 4 bits or lower 4 bits) of each of the first to n-th driving hex values may determine one operating condition. In some embodiments, two or more of the first to n-th driving hex values may determine one operating condition together. For example, the first and second driving hex values may determine a voltage level of the high power voltage ELVDD, the third driving hex value may determine a voltage level of the low power voltage ELVSS, and the fourth to sixth driving hex values and a portion of the n-th driving hex value may determine a voltage level of the analog high voltage AVDD. However, determination of the operating conditions according to the driving hex values is limited thereto.

The power management integrated circuit 130 may include a first authentication register FAR for storing the result hex value that is derived (or calculated) based on the driving hex values. A size of the first authentication register FAR may be smaller than a size of each of the first internal registers FDR. For example, the size (e.g., 4 bits) of the first authentication register FAR may be half of the size (e.g., 8 bits) of each of the first internal registers FUR. In an embodiment, as illustrated in FIG. 2, the first authentication register FAR may be provided separately from the first internal registers FDR. In another embodiment, the first authentication register FAR may be provided by allocating a portion of one of the first internal registers FDR. In still another embodiment, the first authentication register FAR may be provided by allocating portions of two or more of the first internal registers FDR.

According to one embodiment, the power management integrated circuit 130 may divide a driving hex value stored in the first internal registers FDR in an upper decimal value corresponding to the upper 4 bits and a lower decimal value corresponding to the lower 4 bits. In this case, the upper decimal value may have a value between 0 and 15, and the lower decimal may also have a value between 0 and 15. For example, when 'A3' (i.e., a binary value of '10100011') is stored as a k-th driving hex value in the first internal register FDR corresponding to the k-th register address REG-ADR (k)), where k is an integer between 1 and n, the k-th driving hex value may be divided into a hex value 'A' (i.e., '1010') corresponding to the upper 4 bits and a hex value '3' (i.e., '0011') corresponding to the lower 4 bits. In this case, the hex value 'A' (i.e., '1010') corresponding to the upper 4 bits may be expressed by a decimal value '10' (also referred to as an upper decimal value), and the hex value '3' (i.e., '0011') corresponding to the lower 4 bits may be expressed by a decimal value '3' (also referred to as a lower decimal value).

Next, the power management integrated circuit 130 may derive a result decimal value by applying the upper decimal value and the lower decimal value that that correspond to the driving hex value stored in the first internal registers FDR to a first authentication formula and generate a result hex value based on the result decimal value. The power management integrated circuit 130 may use the upper decimal value and the lower decimal value as variables in the first authentication formula to generate the result decimal value, convert the result decimal value to a hex value, and determine at least a portion (e.g., a hex value corresponding to the upper 4 bits and/or a hex value corresponding to the lower 4 bits) of the hex value as the result hex value. Because only the power management integrated circuit 130 can access the first authentication formula and determine the result decimal value, the result hex value that is generated based on the result decimal value can be used as a password for performing an authentication operation between the timing controller 125 and the power management integrated circuit 130.

Subsequently, the power management integrated circuit 130 may compare an authentication hex value corresponding to authentication data AD received from the timing controller 125 with the result hex value and selectively operate in a normal mode or in a protection mode based on the consistency between the authentication hex value and the result hex value. For example, the power management integrated circuit 130 may operate at high performance when the power management integrated circuit 130 operates in the normal mode. On the other hand, the power management integrated circuit 130 may operate at limited performance that is lower than the high performance or may be shut down or power off when the power management integrated circuit 130 operates in the protection mode.

In an embodiment, the power management integrated circuit 130 may operate in the normal mode if the authentication hex value corresponding to the authentication data AD received from the timing controller 125 is consistent with (or matches) the result hex value generated in the power management integrated circuit 130 and operate in the protection mode if the authentication hex value corresponding to the authentication data AD received from the timing controller 125 is inconsistent with (or does not match) the result hex value generated in the power management integrated circuit 130. In another embodiment, the power management integrated circuit 130 may operate in the normal mode if the authentication hex value corresponding to the authentication data AD received from the timing controller 125 is consistent with the result hex value generated in the power management integrated circuit 130 and operate in the protection mode if the authentication hex value corresponding to the authentication data AD is not received from the timing controller 125 within a preset time. That is, the power management integrated circuit 130 may determine not to operate at the high performance if the authentication hex value corresponding to the authentication data AD received from the timing controller 125 is inconsistent with the result hex value generated in the power management integrated circuit 130 or if the authentication hex value corresponding to the authentication data AD is not received from the timing controller 125 within a preset time. In this case, the power management integrated circuit 130 may operate at the limited performance that is lower than the high performance or may be shut down. In this manner, a proprietary technology (e.g., intellectual property) applied to the power management integrated circuit 130 may be prevented from being leaked to other manufacturers.

The power management integrated circuit 130 may receive the authentication hex value corresponding to the authentication data AD from the timing controller 125 and compare it with the result hex value. The timing controller 125 may determine the driving set data DSD based on the input image data in each image frame, store the driving hex values corresponding to the driving set data DSD in the second internal registers SDR, and transmit the driving set data DSD to the power management integrated circuit 130. As illustrated in FIG. 3, the driving hex values stored in the second internal register SDR may be expressed by 8 bits, and each of the second internal registers SDR for storing the driving hex value may have a storage space of 8 bits. For example, a first driving hex value may be stored in a first register address REG-ADR(1) of the second internal register SDR, a second driving hex value may be stored in a second register address REG-ADR(2) of the second internal register SDR, and an n-th driving hex value may be stored in an n-th register address REG-ADR(n) of the second internal register SDR. Here, all (e.g., upper 4 bits and lower 4 bits) or a portion (e.g., upper 4 bits or lower 4 bits) of each of the first to n-th driving hex values may determine one operating condition. In some embodiments, two or more of the first to n-th driving hex values may determine one operating condition together.

According one embodiment, the timing controller 125 may divide a driving hex value stored in the second internal registers SDR in an upper decimal value corresponding to the upper 4 bits and a lower decimal value corresponding to the lower 4 bits. The timing controller 125 may derive an authentication decimal value by applying the upper decimal value and the lower decimal value that correspond to the driving hex value stored in the second internal registers SDR to a second authentication formula, generate the authentication hex value based on the authentication decimal value, and transmit the authentication data AD corresponding to the authentication hex value to the power management integrated circuit 130. The timing controller 125 may use the upper decimal value and the lower decimal value as variables in the second authentication formula to generate the authentication decimal value, convert the authentication decimal value to a hex value, and determine at least a portion (e.g., a hex value corresponding to the upper 4 bits and/or a hex value corresponding to the lower 4 bits) of the hex value as the authentication hex value. Because only the timing controller 125 can access the second authentication formula and determine the authentication decimal value, the authentication hex value that is generated based on the authentication decimal value can be used as a password for performing the authentication operation between the timing controller 125 and the power management integrated circuit 130.

The timing controller 125 may include a second authentication register SAR for storing the authentication hex value that is derived (or calculated) based on the driving hex values. A size of the second authentication register SAR may be smaller than a size of each of the second internal registers SDR. For example, the size (e.g., 4 bits) of the second authentication register SAR may be half of the size (e.g., 8 bits) of each of the second internal registers SDR. In an embodiment, as illustrated in FIG. 3, the second authentication register SAR may be provided separately from the second internal registers SDR. In another embodiment, the second authentication register SAR may be provided by allocating a portion of one of the second internal registers SDR. In still another embodiment, the second authentication register SAR may be provided by allocating portions of two or more of the second internal registers SDR.

As described above, the authentication operation between the timing controller 125 and the power management integrated circuit 130 may be performed by determining whether the authentication hex value generated in the timing controller 125 is consistent with the result hex value generated in the power management integrated circuit 130. In a case where the first internal registers FDR included in the power management integrated circuit 130 and the second internal registers SDR included in the timing controller 125 store the same driving hex values (i.e., the same driving set data), the authentication hex value generated in the timing controller 125 may be consistent with the result hex value generated in the power management integrated circuit 130 as long as the first authentication formula of the power management integrated circuit 130 is the same as the second authentication formula of the timing controller 125. In this case, the authentication between the timing controller 125 and the power management integrated circuit 130 may be successful if the first authentication formula of the power management integrated circuit 130 is the same as the second authentication formula of the timing controller 125. On the other hand, the authentication hex value generated in the timing controller 125 may be inconsistent with the result hex value generated in the power management integrated circuit 130 if the first authentication formula of the power management integrated circuit 130 is different from the second authentication formula of the timing controller 125 (or if the timing controller 125 does not include the second authentication formula for deriving the authentication hex value). In this case, the authentication between the timing controller 125 and the power management integrated circuit 130 may be unsuccessful if the first authentication formula of the power management integrated circuit 130 is different from the second authentication formula of the timing controller 125 (or if the timing controller 125 does not include the second authentication formula for deriving the authentication hex value). For example, in a case where the timing controller 125 is not manufactured by a manufacturer of the power management integrated circuit 130, the timing controller 125 may not possess the first authentication formula of the power management integrated circuit 130 for deriving the result hex value, and thus the authentication hex value generated in the timing controller 125 may be inconsistent with the result hex value generated in the power management integrated circuit 130 or the timing controller 125 may not even provide the authentication hex value. Thus, the power management integrated circuit 130 may determine not to operate at the high performance but to operate at the limited performance lower than the high performance or may be shut down. As a result, the power management integrated circuit 130 may not allow the timing controller 125 that does not possess a proper authentication formula to operate in the high performance mode. In this manner, a proprietary technology (e.g., intellectual property) applied to the power management integrated circuit 130 may be prevented from being leaked to other manufacturers.

In some embodiments, the authentication operation between the timing controller 125 and the power management integrated circuit 130 may be performed according to an update of the driving set data DSD that are determined based on the input image data in each image frame. For example, if a first driving set data corresponding to a first image frame (also referred to as a previous image frame) is different from a second driving set data corresponding to a second image frame (also referred to as a current image frame) following the first image frame, the authentication operation may be performed during the second image frame. In this case, the timing controller 125 may provide the second driving set data that is different from the first driving set data to the power management integrated circuit 130 and then may provide the authentication data AD for performing the authentication operation to the power management integrated circuit 130 during the second image frame. Specifically, if the timing controller 125 determines that the second driving set data in the second image frame is different from the first driving set data in the first image frame, the timing controller 125 may update the driving set data DSD in the second internal registers SDR and transmit the updated driving set data DSD to the power management integrated circuit 130 during the second image frame. Since the driving hex values are divided into the upper decimal values and the lower decimal values, the timing controller 125 may derive the authentication decimal value by applying the upper decimal values and the lower decimal values to the second authentication formula and store the authentication decimal value in the second authentication registers SAR. The power management integrated circuit 130 may receive the updated driving set data DSD from the timing controller 125 and update the driving set data DSD in the first internal registers FDR during the second image frame. Since the updated driving set data DSD is divided into the upper decimal values and the lower decimal values, the power management integrated circuit 130 may derive the result decimal value by applying the upper decimal values and the lower decimal values to the first authentication formula and store the result decimal value in the first authentication registers FAR. Next, the timing controller 125 may transmit the authentication data AD corresponding to the authentication decimal value stored in the second authentication register SAR to the power management integrated circuit 130, and the power management integrated circuit 130 may compare the authentication decimal value received from the timing controller 125 with the result decimal value stored in the first authentication register FAR and determine to selectively operate in the normal mode or in the protection mode according to according to a comparison result between the authentication hex value and the result hex value.

Referring back to FIG. 1, the power management integrated circuit 130 generates the driving voltages for driving the display panel 110 and the display panel driving circuit 120 (i.e., denoted as POW) based on the driving set data DSD received from the timing controller 125 of the display panel driving circuit 120 stores the driving hex values corresponding to the driving set data DSD in the first internal registers FDR, and determines the operating conditions including the voltage levels of the driving voltages based on the driving hex values (i.e., denoted CTL). The display device 100 may selectively operate the power management integrated circuit 130 in the normal mode or in the protection mode according to the authentication between the timing controller 125 and the power management integrated circuit 130. The timing controller 125 and the power management integrated circuit 130 may perform a specific communication (e.g., an $I^2C$ communication) to change the operating conditions, for example, to change the voltage levels of the driving voltages for driving the display panel 110 and the display panel driving circuit 120. As a result, in a case where the display panel 110 and the display panel driving circuit 120 are manufactured by other manufacturers other than the manufacturer of the power management integrated circuit 130, and the specifications of the display panel 110 and the display panel driving circuit 120 may be identified to the power management integrated circuit 130, the power management integrated circuit 130 may not operate in the normal mode (e.g., high performance mode) if the authentication between the timing controller 125 included in the display panel driving circuit 120 and the power management integrated circuit 130 fails. In this manner, a proprietary technology applied to the power management integrated circuit 130 by the manufacturer of the power management integrated circuit 130 may be prevented from being leaked to other manufacturers.

Figure 4:
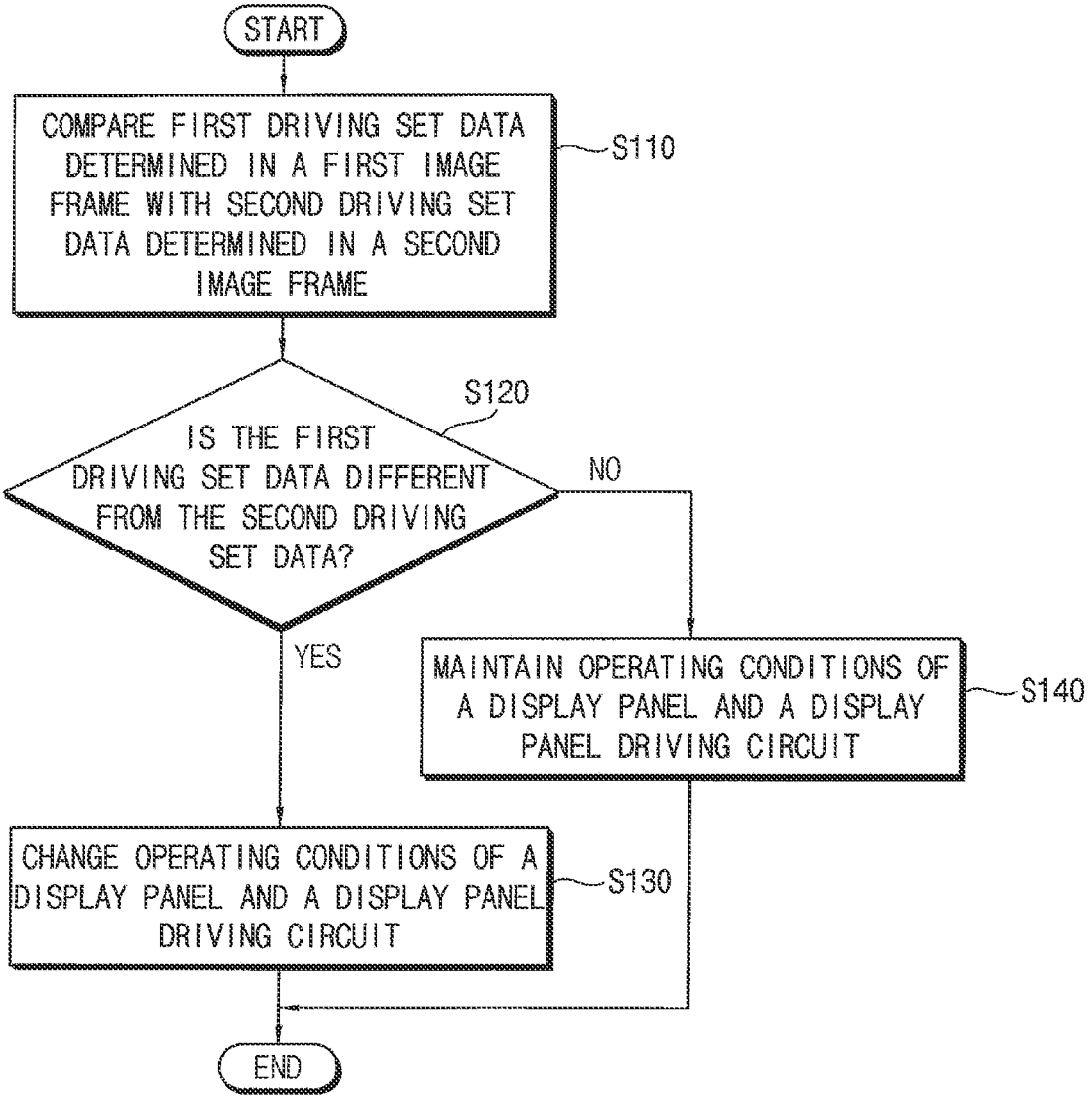
FIG. 4 is a flowchart illustrating an example in which a timing controller and a power management integrated circuit change operating conditions in the display device of FIG. 1.
Figure 5:
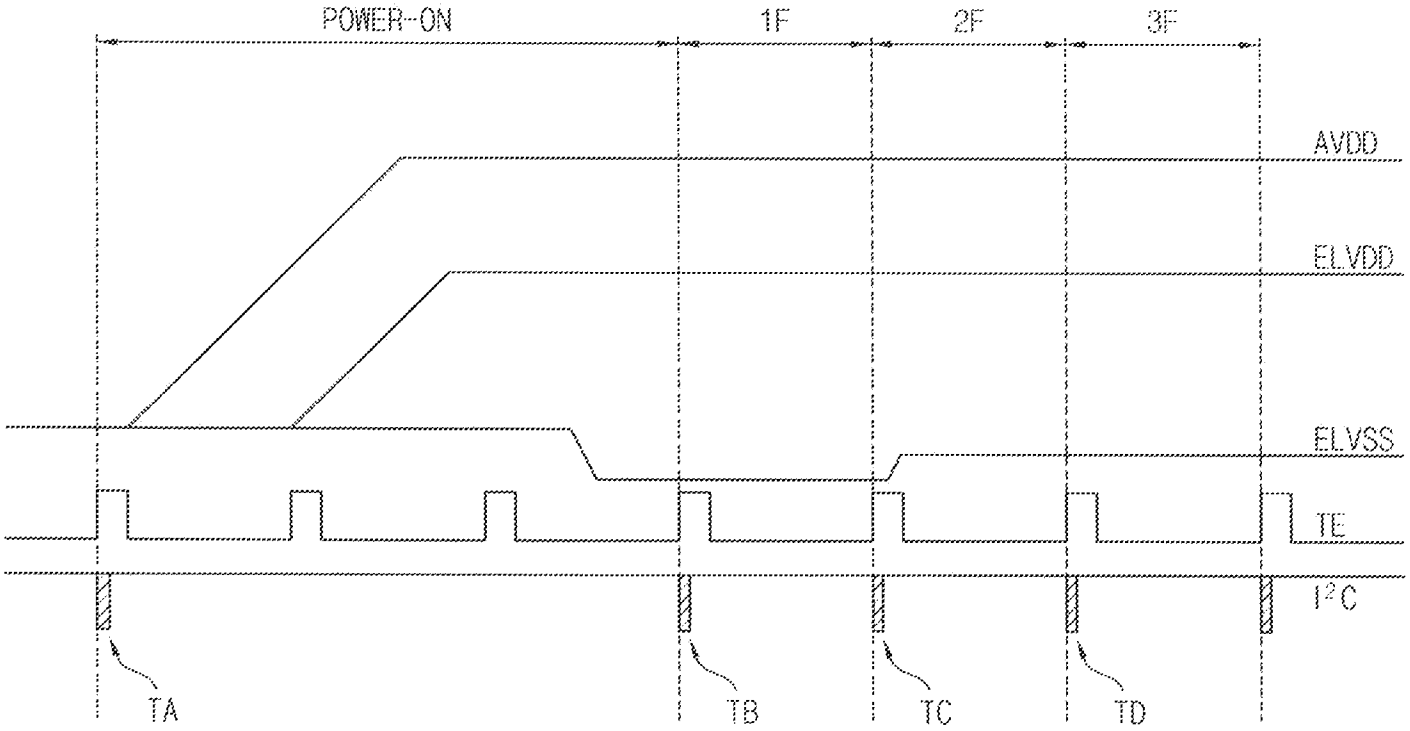
FIG. 5 is a timing diagram for changing operating conditions in the display device of FIG. 1.

FIG. 4 is a flow chart illustrating an example in which the timing controller 125 and the power management integrated circuit 130 change operating conditions in the display device 100 of FIG. 1, and FIG. 5 is a timing diagram for changing operating conditions in the display device 100 of FIG. 1.

Referring to FIGS. 4 and 5, the timing controller 125 and the power management integrated circuit 130 may change the operating conditions based on the image data input in the first, second, and third image frames 1F, 2F, and 3F. In FIG. 5, each of the image frames 1F, 2F, and 3F is defined by a periodic signal TE (also referred to as a tearing effect signal). For example, one cycle of the periodic signal TE may correspond to one of the images frame 1F, 2F, and 3F. An PC communication may be performed between the timing controller 125 and the power management integrated circuit 130 at a timing point at which a level of the periodic signal TE is changed from a low level to a high level (e.g., at a rising edge). Specifically, the timing controller 125 may compare the first driving set data determined in the first image frame (also referred to as the previous image frame) with the second driving set data determined in the second image frame (also referred to the current image frame) following the first image frame (S110) and determine whether the first driving set data is different from the second driving set data (S120). Here, if the first driving set data is different from the second driving set data, the power management integrated circuit 130 may change the operating conditions of the display panel 110 and the display panel driving circuit 120 (S130). On the other hand, if the first driving set data is the same as the second driving set data, the power management integrated circuit 130 may maintain the operating conditions of the display panel 110 and the display panel driving circuit 120 (S140). The operating conditions of the display panel 110 and the display panel driving circuit 120 may include the voltage levels of the driving voltages ELVDD, ELVSS, and AVDD for driving the display panel 110 and the display panel driving circuit 120. However, the operating conditions of the display panel 110 and the display panel driving circuit 120 are not limited thereto. For example, the operating conditions of the display panel 110 and the display panel driving circuit 120 may further include various operations that the power management integrated circuit 130 can perform for the display panel 110 and the display panel driving circuit 120 as well as the voltage levels of the driving voltages ELVDD, ELVSS, and AVDD=.

For example, as illustrated in FIG. 5, the display device 100 may be turned on, and the first $I^2C$ communication (denoted as TA) may be performed between the timing controller 125 and the power management integrated circuit 130. During a power-on period POWER-ON, the analog high voltage AVDD, the high power voltage ELVDD, and the low power voltage ELVSS may be respectively set to their initial voltage levels according to the first $I^2C$ communication.

Next, the first image frame 1F may start in response to the periodic signal TE, the second $I^2C$ communication (denoted as TB) may be performed between the timing controller 125 and the power management integrated circuit 130 at a rising edge of the periodic signal TE, and the driving set data DSD may be determined based on the image data input in the first image frame 1F. The voltage levels of the analog high voltage AVDD, the high power voltage ELVDD, and the low power voltage ELVSS may be determined based on the driving hex values corresponding to the driving set data DSD in the first image frame 1F. In FIG. 5, the voltage levels of the analog high voltage AVDD, the high power voltage ELVDD, and the low power voltage ELVSS are reached to their initial voltage levels during the power-on period POWER-ON.

Subsequently, the second image frame 2F may start in response to the periodic signal TE, the third $I^2C$ communication (denoted as TC) may be performed between the timing controller 125 and the power management integrated circuit 130 at a rising edge of the periodic signal TE, and the driving set data DSD may be determined based on the image data input in the second image frame 2F. The voltage levels of the analog high voltage AVDD, the high power voltage ELVDD, and the low power voltage ELVSS may be determined based on the driving hex values corresponding to the driving set data DSD in the second image frame 2F. In the present example of FIG. 5, the voltage level of the low power voltage ELVSS is changed while the voltage levels of the analog high voltage AVDD and the high power voltage ELVDD remain unchanged. Therefore, the driving set data DSD are updated in the second image frame 2F, and the authentication operation between the timing controller 125 and the power management integrated circuit 130 may be performed.

Subsequently, the third image frame 3F may start in response to the periodic signal TE, the fourth PC communication (denoted as TD) may be performed between the timing controller 125 and the power management integrated circuit 130 at a rising edge of the periodic signal TE, and the driving set data DSD may be determined based on the image data input in the third image frame 3F. The voltage levels of the analog high voltage AVDD, the high power voltage ELVDD, and the low power voltage ELVSS may be determined based on the driving hex values corresponding to the driving set data DSD in the third image frame 3F. In the present example of FIG. 5 that the voltage levels of the analog high voltage AVDD, the high power voltage ELVDD, and the low power voltage ELVSS are maintained, and no authentication operation between the timing controller 125 and the power management integrated circuit 130 may be performed. In this way, the timing controller 125 and the power management integrated circuit 130 may update the driving set data DSD based on the image data input in each of the first, second, and third image frame 1F, 2F, and 3F and perform the authentication operation based on a change of the operating conditions as the driving set data DSD are updated.

Figure 6:
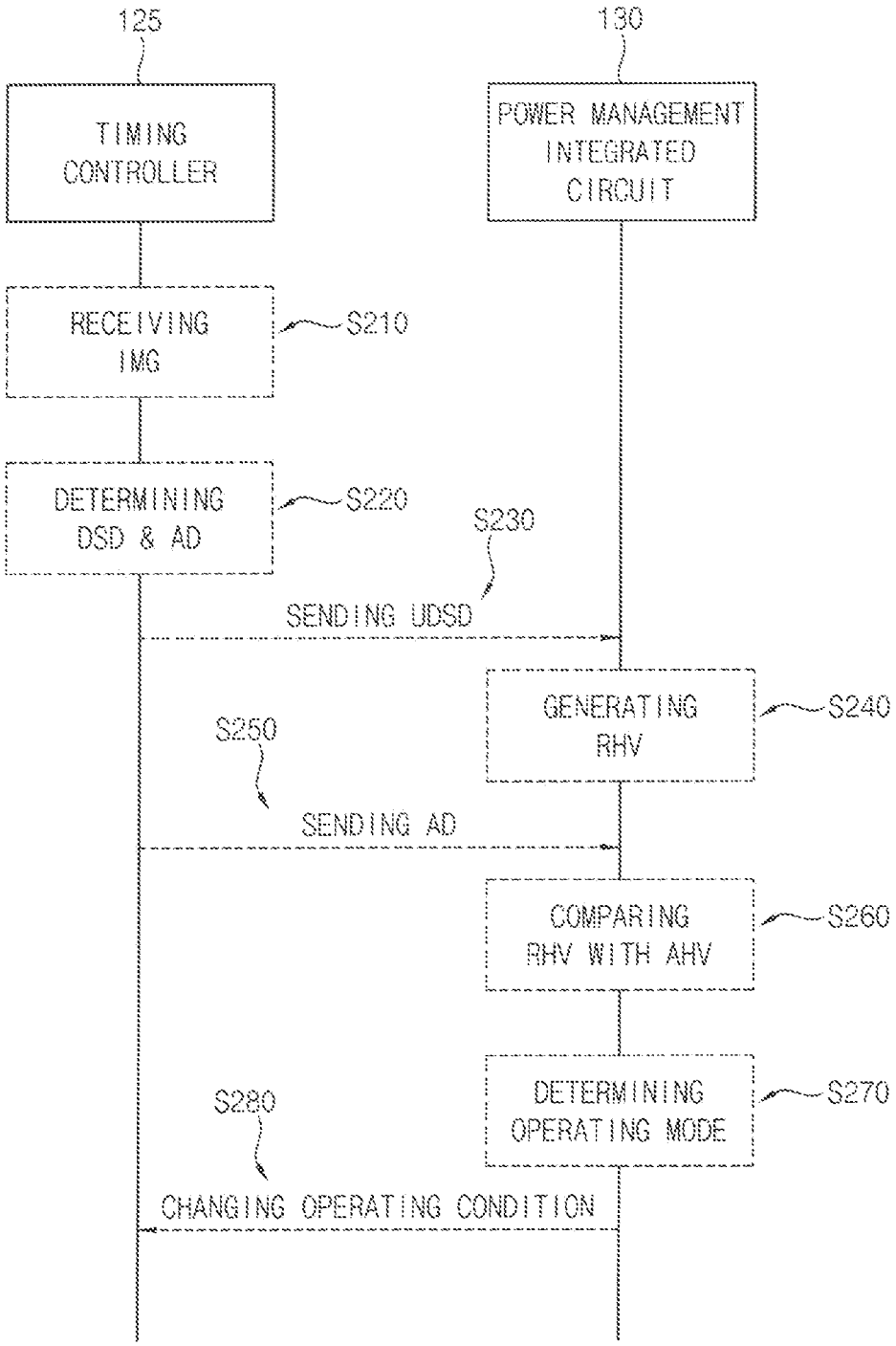
FIG. 6 is a diagram illustrating a process of an authentication operation according to an embodiment.

FIG. 6 is a diagram illustrating a process of an authentication operation according to an embodiment, FIGS. 7A and 7B illustrate examples for describing an operation of the power management integrated circuit 130 as a part of an authentication operation performed between the timing controller 125 and the power management integrated circuit 130 in the display device 100 of FIG. 1, and FIGS. 8A and 8B illustrate examples for describing an operation of the timing controller 125 as a part of an authentication operation performed between the timing controller 125 and the power management integrated circuit 130 in the display device 100 of FIG. 1.

Referring to FIGS. 6 to 8B, an authentication operation may be performed between the timing controller 125 and the power management integrated circuit 130 using a specific communication (e.g., an PC communication).

The timing controller 125 may receive the image data IMG from an external component (e.g., an image processor or the like) according to an image frame (S210) and determine the driving set data DSD and the authentication data AD based on the image data IMG (S220). Here, the timing controller 125 may store the driving set data DSD in the second internal register SDR and the authentication data AD in the second authentication register SAR, respectively.

In an embodiment, as illustrated in FIGS. 8A and 8B, the second authentication register SAR may be stored in a portion of one of the second internal registers SDR (e.g., upper 4 bits UDV of the second internal register SDR corresponding to the ninth register address (i.e., '08h')). In another embodiment, the second authentication register SAR may be stored in portions of at least two of the second internal registers SDR. In still another embodiment, the second authentication register SAR may be stored separately from the second internal registers SDR.

In the example of FIG. 8A, the timing controller 125 may store the driving hex values 'E1', 'EF', 'EF', '66', '6E', '36', '88', '87', and '0E' corresponding to the driving set data DSD in the first to ninth register addresses '00h' to '08h' of the second internal registers SDR. In a case where the second authentication register SAR stores an authentication hex value AHV in the upper 4 bits UDV of the ninth register address '08h' of the second internal register SDR and has value of '1', the hex value stored in the ninth register address '08h' of the second internal register SDR may have the hex value of '1E', in which the upper 4 bits UDV corresponding to the second authentication register SAR has a hex value of '1', and the lower 4 bits LDV has the driving hex value of '0E'.

In the example of FIG. 8B, the driving hex values 'E5', 'EF', 'EF', '66', '6E', '36', '88', '87', and '0E' corresponding to the driving set data DSD are stored in the first to ninth register addresses '00h' to '08h' of the second internal registers SDR. In a case where the second authentication register SAR that stores the authentication hex value AHV is changed from '1' to 'A', the hex value stored in the ninth register address '08h' may be updated from '1E' to 'AE'.

When storing the driving set data DSD that are determined based on the image data IMG in the second internal registers SDR, the timing controller 125 may not update all of the driving set data DSD in the second internal registers SDR in each image frame. Instead, the timing controller 125 may update only anupdated driving set data UDSD. In other words, the timing controller 125 may compare the previous driving set data DSD determined in the previous image frame with the current driving set data DSD determined in the current image frame and update only the driving set data DSD that is updated from the previous driving set data DSD to the current driving set data DSD that is different from the previous driving set data DSD in the second internal registers SDR. For example, as illustrated in FIGS. 8A and 8B, the updated driving set data UDSD includes the driving set data DSD that is stored in the first register address '00h' (denoted as 'E1→E5') of the second internal register SDR.

In addition, the timing controller 125 may divide the driving hex values stored in the second internal registers SDR into the upper decimal values and the lower decimal values, derive the authentication decimal value by applying the upper decimal values and the lower decimal values to the second authentication formula, and generate the authentication hex value AHV based on the authentication decimal value. In the example of FIG. 8A, the timing controller 125 may divide the driving hex values 'E1', 'EF', 'EF', '66', '6E', '36', '88', '87', '0E' stored in the second internal registers SDR into the upper decimal values '14', '14', '14', '6', '6', '3', '8', and '8' and the lower decimal values '1', '15', '15', '6', '14', '6', '8', '7', and '14', derive the authentication decimal value of '1' by applying the upper decimal values and the lower decimal values to the second authentication formula, and generate the authentication hex value AHV of '1' based on the authentication decimal value of '1'.

For example, the timing controller 125 may generate the authentication hex value AHV (i.e., '1') by converting the authentication decimal value (i.e., '1') to a hex value. Since the authentication hex value AHV is stored in the second authentication register SAR as a portion of the second internal register SDR corresponding to the ninth register address '08h' and have a value of '1', '1E' may be stored in the second authentication register SAR (i.e., the upper 4 bits UDV) and the second internal register SDR (i.e., the lower 4 bits LDV). The timing controller 125 may compare the previous driving set data DSD determined in the previous image frame with the current driving set data DSD determined in the current image frame and update only the updated driving set data UDSD that is changed from the previous driving set data DSD to the current driving set data DSD in the second internal registers SDR. As illustrated in FIG. 8B, the driving set data DSD stored in the first register address '00h' of the second internal registers SDR is updated from the previous driving set data DSD of 'E1' to the current driving set data DSD of 'E5' (denoted as E1→E5), and the timing controller 125 may divide the driving hex values (i.e., 'E5', 'EF', 'EF', '66', '6E', '36', '88', '87', '0E') stored in the second internal registers SDR into the upper decimal values (i.e., '14', '14', '14', '6', '6', '3', '8', '8') and the lower decimal values (i.e., '5', '15', '15', '6', '14', '6', '8', '7', '14'), derive the authentication decimal value of '10' by applying the upper decimal values and the lower decimal values to the second authentication formula, and generate the authentication hex value AHV having a hex value of 'A' based on the authentication decimal value '10'. For example, the timing controller 125 may generate the authentication hex value AHV (i.e., 'A') by converting the authentication decimal value (i.e., '10') to the hex value. Since the authentication hex value AHV stored in the second authentication register SAR as a portion of the second internal register SDR corresponding to the ninth register address '08h' has a value of 'A', 'AE' may be stored in the ninth address '08h' of the second internal registers SDR, in which the authentication hex value AHV of 'A' is stored in the upper 4 bits UDV, and the decimal value of '14' is stored in the lower 4 bits LDV.

Subsequently, the timing controller 125 may transmit the driving set data DSD that are determined based on the image data IMG to the power management integrated circuit 130 (S230). Here, the power management integrated circuit 130 may store the driving set data DSD in the first internal register FDR and the result hex value RHV in the first authentication register FAR, respectively.

In an embodiment, as illustrated in FIGS. 7A and 7B, the first authentication register FAR may be stored in a portion of one of the first internal registers FDR (e.g., upper 4 bits UDV of the first internal register FDR corresponding to the ninth register address (i.e., '08h')). In another embodiment, the first authentication register FAR may be stored in portions of at least two of the first internal registers FUR. In still another embodiment, the first authentication register FAR may be provided separately from the first internal registers FDR.

In the example of FIG. 7A, the power management integrated circuit 130 may store the driving hex values 'E1', 'EF', 'EF', '66', '6E', '36', '88', '87', and '0E' corresponding to the driving set data DSD in the first to ninth register addresses '00h' to '08h' of the first internal registers FDR. In a case where the first authentication register FAR that stores the authentication hex value AHV in the upper 4 bits UDV of the ninth register address '08h' of the first internal register FDR and has value of '1', the hex value stored in the ninth register address '08h' of the first internal register FDR may have the hex value of '1E' in which the upper 4 bits UDV corresponding to the second authentication register SAR has a hex value of '1, and the lower 4 bits LDV has the driving hex value of '0E'.

In the example of FIG. 7B, the driving hex values 'E5', 'EF', 'EF', '66', '6E', '36', '88', '87', and '0E' corresponding to the driving set data DSD are stored in the first to ninth register addresses '00h' to '08h' of the first internal registers FDR. In a case where the first authentication register FAR that stores the authentication hex value AHV is changed from '1' to 'A', the hex value stored in the ninth register address '08h' may be updated from '1E' to 'AE'.

The timing controller 125 may not transmit all of the driving set data DSD that are determined based on the image data IMG in each image frame to the power management integrated circuit 130. Instead, the timing controller 125 may transmit only the updated driving set data UDSD to the power management integrated circuit 130. Thus, the power management integrated circuit 130 may update only the updated driving set data UDSD in the first internal registers FDR. For example, as illustrated in FIGS. 7A and 7B, the updated driving set data UDSD includes the driving set data DSD that is stored in the first register address '00h' (denoted as E1→E5) of the first internal register FDR.

In addition, the power management integrated circuit 130 may divide the driving hex values stored in the first internal registers FDR into the upper decimal values and the lower decimal values, derive the result decimal value by applying the upper decimal values and the lower decimal values to the first authentication formula, and generate the result hex value RHV based on the result decimal value (S240). In the example of FIG. 7A, the power management integrated circuit 130 may divide the driving hex values 'E1', 'EF', 'EF', '66', '6E', '36', '88', '87', '0E' stored in the first internal registers FDR into the upper decimal values '14', '14', '14', '6', '6', '3', '8', '8' and the lower decimal values '1', '15', '15', '6', '14', '6', '8', '7', '14', derive the result decimal value of '1' by applying the upper decimal values and the lower decimal values to the first authentication formula, and generate the result hex value RHV of '1' based on the result decimal value of '1'.

For example, the power management integrated circuit 130 may generate the result hex value RHV (i.e., '1') by converting the result decimal value (i.e., '1') to a hex value. Since the result hex value RHV stored in the first authentication register FAR as a portion of the first internal register FDR corresponding to the ninth register address '08h' and has a value of '1', '1E' may be stored in the first authentication register FAR (i.e., the upper 4 bits UDV) and the first internal register FDR (i.e., the lower 4 bits LDV) that correspond to the ninth register address (i.e., '08h'). The power management integrated circuit 130 may update only the updated driving set data UDSD among the driving set data DSD that is changed from the previous driving set data DSD to the current driving set data DSD in the first internal registers FDR. As illustrated in FIG. 7B, the driving set data DSD stored in the first register address of 'ooh' of the first internal registers FDR is updated from the previous driving set data DSD of 'E1' to the current driving set data DSD of 'E5' (denoted as E1→E5), and the power management integrated circuit 130 may divide the driving hex values stored in the first internal registers FDR into the upper decimal values and the lower decimal values, derive the result decimal value of '10' by applying the upper decimal values and the lower decimal values to the first authentication formula, and generate the result hex value RHV having a hex value of 'A' based on the result decimal value '10'. For example, the power management integrated circuit 130 may generate the result hex value RHV (i.e., 'A') by converting the result decimal value (i.e., '10') to the hex value. Since the result hex value RHV stored in the first authentication register FAR as a portion of the first internal register FDR corresponding to the ninth register address '08h' and has a value of 'A', 'AE' may be stored in the ninth address '08h' of the first internal registers FUR, in which the result hex value RHV of 'A' is stored in the upper 4 bits UDV, and the decimal value of '14' is stored in the lower 4 bits LDV.

Next, the timing controller 125 may transmit the driving set data DSD and the authentication data AD corresponding to the authentication hex value AHV to the power management integrated circuit 130 (S250). The power management integrated circuit 130 may compare the authentication hex value AHV received from the timing controller 125 with the result hex value RHV (S260) and determine an operating mode of the power management integrated circuit 130 according to a comparison result between the authentication hex value AHV and the result hex value RHV (S270).

If the authentication hex value AHV is consistent with the result hex value RHV, the power management integrated circuit 130 may operate in the normal mode (e.g., the high performance mode). On the other hand, if the authentication hex value AHV is inconsistent with the result hex value RHV or if the authentication hex value AHV is not received from the timing controller 125 within a preset time, the power management integrated circuit 130 may operate in the protection mode (e.g., the limited performance mode or the shut-down mode). In the example of FIGS. 7A and 8A, the power management integrated circuit 130 may operate in the normal mode because the authentication hex value AHV is '1', the result hex value RHV is '1', and the authentication hex value AHV (i.e., '1') is consistent with the result hex value RHV (i.e., '1'). In the example of FIGS. 7B and 8B, the power management integrated circuit 130 may operate in the normal mode (denoted as OK) because the authentication hex value AHV is 'A', the result hex value RHV is 'A', and the authentication hex value AHV (i.e., 'A') is consistent with the result hex value RHV (i.e., 'A'). On the other hand, the power management integrated circuit 130 may operate in the protection mode (denoted as ERROR) if the authentication hex value AHV is 'F', the result hex value RHV is 'A', and the authentication hex value AHV (i.e., 'F') is inconsistent with the result hex value RHV (i.e., 'A').

Subsequently, the power management integrated circuit 130 may change the operating conditions, for example, the voltage levels of the driving voltages for driving the display panel 110 and the display panel driving circuit 120 based on the operating mode that is determined according to the comparison result between the authentication hex value AHV and the result hex value RHV (S280). As described above, because the first internal registers FDR included in the power management integrated circuit 130 and the second internal registers SDR included in the timing controller 125 store the same driving hex values (i.e., the driving set data DSD), the authentication hex value AHV may be consistent with the result hex value RHV if the first authentication formula of the power management integrated circuit 130 for deriving the result hex value RHV is the same as the second authentication formula of the timing controller 125 for deriving the authentication hex value AHV. Thus, the power management integrated circuit 130 may operate in the normal mode if the authentication between the timing controller 125 and the power management integrated circuit 130 is determined to be successful as a result of the authentication hex value AHV being consistent with the result hex value RHV. On the other hand, if the first authentication formula of the power management integrated circuit 130 for deriving the result hex value RHV is different from the second authentication formula of the timing controller 125 for deriving the authentication hex value AHV (or when the timing controller 125 does not include the second authentication formula for deriving the authentication hex value AHV), the authentication hex value AHV generated in the timing controller 125 may be inconsistent with the result hex value RHV generated in the power management integrated circuit 130. Thus, the power management integrated circuit 130 may operate in the protection mode because the authentication between the timing controller 125 and the power management integrated circuit 130 is unsuccessful as a result of the authentication hex value AHV being inconsistent with the result hex value RHV=. Therefore, in the case that the timing controller 125 is not manufactured by the manufacturer of the power management integrated circuit 130, the timing controller 125 does not possess the first authentication formula of the power management integrated circuit 130 for deriving the result hex value RHV, and thus the authentication hex value AHV generated in the timing controller 125 may be inconsistent with the result hex value RHV generated in the power management integrated circuit 130. Thus, the power management integrated circuit 130 may determine not to operate at the high performance but to operate at the limited performance lower than the high performance or may be shut down. As a result, the power management integrated circuit 130 may not provide the high performance operation to the timing controller 125 that does not possess the first authentication formula of the power management integrated circuit 130 for deriving the result hex value RHV, and a proprietary technology (e.g., intellectual property) applied to the power management integrated circuit 130 may be prevented from being leaked to other manufacturers.

Figure 9:
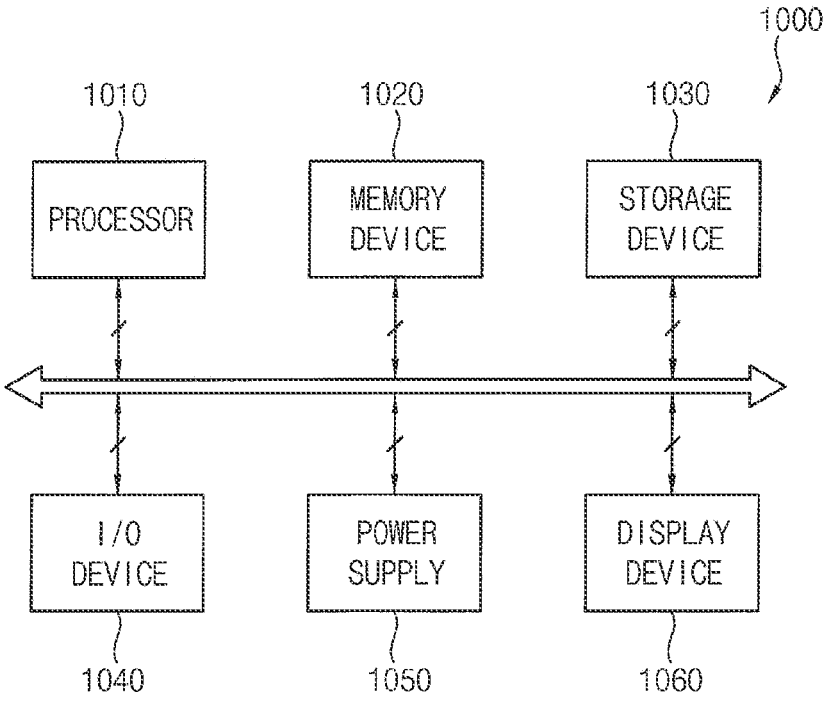
FIG. 9 is a block diagram of an electronic device according to an embodiment.
Figure 10:
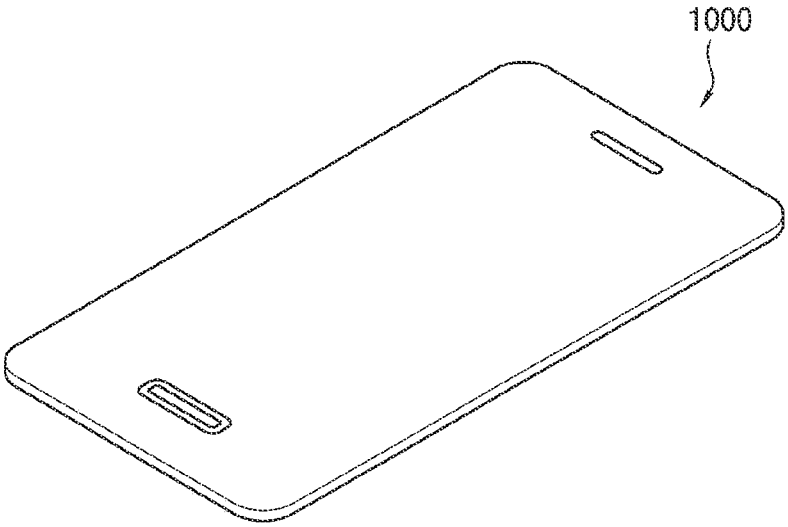
FIG. 10 illustrates an example of the electronic device of FIG. 9 implemented as a smart phone.

FIG. 9 is a block diagram of an electronic device according to an embodiment, and FIG. 10 illustrates an example of the electronic device of FIG. 9 implemented as a smart phone.

Referring to FIGS. 9 and 10, an electronic device 1000 may include a processor 1010, a memory device 1020, a storage device 1030, an input/output (I/O) device 1040, a power supply 1050, and a display device 1060. The display device 1060 may be the display device 100 of FIG. 1. In addition, the electronic device 1000 may further include a plurality of ports for communicating with a video card, a sound card, a memory card, a universal serial bus (USB) device, other electronic devices, etc. As illustrated in FIG. 10, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop computer, a head mounted display (HMD) device, or the like.

The processor 1010 may perform various computing tasks. The processor 1010 may be a micro-processor, a central processing unit (CPU), an application processor (AP), or the like. The processor 1010 may be coupled to other components via an address bus, a control bus, a data bus, etc. Further, the processor 1010 may be coupled to an extended bus such as a peripheral component interconnection (PCI) bus. The memory device 1020 may store data of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, or the like and/or at least one volatile memory device such as a dynamic random access memory (DRAM) device, a static random access memory (SRAM) device, a mobile DRAM device, or the like. The storage device 1030 may include a solid state drive (SSD) device, a hard disk drive (HDD) device, a CD-ROM device, or the like. The I/O device 1040 may include an input device such as a keyboard, a keypad, a mouse device, a touch-pad, a touch-screen, or the like and an output device such as a printer, a speaker, or the like. In some embodiments, the display device 1060 may be included as the I/O device 1040. The power supply 1050 may provide power for operating the electronic device 1000.

The display device 1060 may display an image corresponding to visual information of the electronic device 1000. The display device 1060 may be coupled to other components via buses and/or communication links. The display device 1060 may include a display panel (e.g., the display panel 110 of FIG. 1) including a plurality of pixels, a display panel driving circuit (e.g., the display panel driving circuit 120) that drives the display panel, and a power management integrated circuit (e.g., the power management integrated circuit 130 of FIG. 1) that generates driving voltages for driving the display panel and the display panel driving circuit based on driving set data (e.g., the driving set data DSD) from a timing controller (e.g., the timing controller 125 of FIG. 1) included in the display panel driving circuit.

The power management integrated circuit may store driving hex values corresponding to the driving set data in first internal registers FDR and determines operating conditions such as voltage levels of the driving voltages based on the driving hex values. Here, the power management integrated circuit may divide the driving hex values stored in the first internal registers FUR into upper decimal values UDV and lower decimal values LDV, derive a result decimal value by applying the upper decimal values and the lower decimal values to a first authentication formula, generate a result hex value (in some embodiment, the result hex value may be stored in the first authentication register included in the power management integrated circuit) based on the result decimal value, compare an authentication hex value corresponding to authentication data received from the timing controller with the result hex value, and selectively operate in a normal mode or in a protection mode according to a comparison result between the authentication hex value and the result hex value.

The power management integrated circuit may operate in the normal mode if the authentication hex value is consistent with the result hex value. On the other hand, the power management integrated circuit may operate in the protection mode if the authentication hex value is inconsistent with the result hex value or the power management integrated circuit does not receive the authentication hex value from the timing controller within a preset time. In addition, the timing controller may determine the driving set data based on input image data in each image frame, store the driving hex values corresponding to the driving set data in the second internal registers SDR, and transmit the driving set data to the power management integrated circuit. The timing controller may divide the driving hex values stored in the second internal registers SDR into the upper decimal values and the lower decimal values, derive an authentication decimal value by applying the upper decimal values and the lower decimal values to a second authentication formula, generate the authentication hex value based on the authentication decimal value (in some embodiments, the authentication hex value may be stored in the second authentication register included in the timing controller), and transmit the authentication data corresponding to the authentication hex value to the power management integrated circuit. The display device 1060 may selectively operate the power management integrated circuit in the normal mode (e.g., a high performance mode) or in the protection mode (e.g., a limited performance mode or a shut-down mode) according to the authentication between the timing controller and the power management integrated circuit via a specific communication (e.g., an PC communication). As a result, the display device 1060 may prevent a technology applied to a specific power management integrated circuit by a manufacturer of the specific power management integrated circuit from being leaked to other manufacturers. Since these are described above, duplicated description related thereto is not repeated.

The present inventive concept may be applied to a display device and an electronic device including the display device. For example, the present inventive concept may be applied to a smart phone, a cellular phone, a video phone, a smart pad, a smart watch, a tablet PC, a car navigation system, a television, a computer monitor, a laptop, a head mounted display (HMD) device, an MP3 player, or the like.

The foregoing is illustrative of the exemplary embodiments of the present disclosure and is not to be construed as limiting thereof. Although some embodiments have been described, those skilled in the art will readily appreciate that many modifications are possible in the disclosed embodiments without materially departing from the novel teachings and advantages of the present inventive concept. Accordingly, such modifications are intended to be included within the scope of the present inventive concept. Therefore, it is to be understood that the foregoing is illustrative of various embodiments of the present disclosure and is not to be construed as limited to the specific embodiments disclosed, and that modifications to the disclosed embodiments, as well as other embodiments, are intended to be included within the scope of the present disclosure including the appended claims.

What is claimed is:

1. A display device comprising:

a display panel;

a display panel driving circuit including a timing controller and configured to drive the display panel; and a power management integrated circuit configured to generate a plurality of driving voltages for driving the display panel and the display panel driving circuit, receive driving set data from the timing controller, store driving hex values corresponding to the driving set data in first internal registers, and determine voltage levels of the plurality of driving voltages based on the driving hex values, wherein the power management integrated circuit divides the driving hex values into upper values corresponding to upper hex values and lower values corresponding to lower hex values, derives a result value by performing a first authentication calculation using the upper values and the lower values, generates a result hex value based on the result value, compares an authentication hex value corresponding to authentication data received from the timing controller with the result hex value, and selectively operates in a normal mode or in a protection mode based on a comparison result between the authentication hex value and the result hex value.

2. The display device of claim 1, wherein the timing controller and the power management integrated circuit perform an inter integrated circuit ($I^2C$) communication for performing an authentication operation between the timing controller and the power management integrated circuit.

3. The display device of claim 2, wherein the power management integrated circuit operates in the normal mode if the authentication hex value is consistent with the result hex value and operates in the protection mode if the authentication hex value is inconsistent with the result hex value.

4. The display device of claim 2, wherein the power management integrated circuit operates in the normal mode if the authentication hex value is consistent with the result hex value and operates in the protection mode if the authentication hex value is not received from the timing controller within a preset time.

5. The display device of claim 1, wherein, if first driving set data that are determined in a first image frame is different from second driving set data that are determined in a second image frame following the first image frame, an authentication operation is performed between the timing controller and the power management integrated circuit during the second image frame.

6. The display device of claim 5, wherein the timing controller provides at least one updated driving set data among the driving set data that is changed from the first driving set data to the second driving set data to the power management integrated circuit and provides the authentication data to the power management integrated circuit during the second image frame.

7. The display device of claim 1, wherein the timing controller determines the driving set data based on image data input in each image frame, stores the driving hex values corresponding to the driving set data in second internal registers, and transmits the driving set data to the power management integrated circuit.

8. The display device of claim 7, wherein the timing controller compares first driving set data that are determined in a first image frame with second driving set data that are determined in a second image frame following the first image frame, and wherein the timing controller updates at least one updated driving set data among the driving set data that is changed from the first driving set data to the second driving set data in the second internal registers and transmits the at least one updated driving set data to the power management integrated circuit during the second image frame.

9. The display device of claim 8, wherein the power management integrated circuit updates the at least one updated driving set data received from the timing controller in the first internal registers during the second image frame.

10. The display device of claim 7, wherein the timing controller divides the driving hex values into the upper values and the lower values, derives an authentication value by performing a second authentication calculation using the upper values and the lower values, generates the authentication hex value based on the authentication value, and transmits the authentication hex value to the power management integrated circuit.

11. The display device of claim 10, wherein the upper values and the lower values are used as variables in a first authentication formula which the first authentication calculation is based on.

12. The display device of claim 11, wherein the power management integrated circuit has an exclusive access to the first authentication formula that the timing controller does not have.

13. The display device of claim 10, wherein the upper values and the lower values are used as variables in a second authentication formula which the second authentication calculation is based on.

14. The display device of claim 13, wherein the timing controller has an exclusive access to the second authentication formula that the power management integrated circuit does not have.

15. The display device of claim 13, wherein the authentication hex value is consistent with the result hex value if the first authentication formula is same as the second authentication formula, and the authentication hex value is inconsistent with the result hex value if the first authentication formula is different from the second authentication formula.

16. The display device of claim 1, wherein the power management integrated circuit further includes a first authentication register for storing the result hex value, and a first size of the first authentication register is half of a second size of each of the first internal registers.

17. The display device of claim 16, wherein the timing controller further includes a second authentication register for storing the authentication hex value, and a third size of the second authentication register is half of a fourth size of each of the second internal registers.

18. The display device of claim 17, wherein the first authentication register is stored in a first portion of at least one of the first internal registers, and the second authentication register is stored in a second portion of at least one of the second internal registers.

19. The display device of claim 1, wherein the power management integrated circuit operates at high performance based on the power management integrated circuit operating in the normal mode.

20. The display device of claim 19, wherein the power management integrated circuit operates at limited performance lower than the high performance in the protection mode.

21. The display device of claim 19, wherein the power management integrated circuit is shut down in the protection mode.

22. An electronic device comprising:

a processor configured to perform computing tasks for the electronic device;

an I/O device configured to perform input and output functions for the electronic device;

a memory device configured to store data for the electronic device; and a display device configured to display an image corresponding to visual information for the electronic device, wherein a display device includes:

a display panel;

a display panel driving circuit including a timing controller and configured to drive the display panel; and a power management integrated circuit configured to generate a plurality of driving voltages for driving the display panel and the display panel driving circuit, receive driving set data from the timing controller, store driving hex values corresponding to the driving set data in first internal registers, and determine voltage levels of the plurality of driving voltages based on the driving hex values, and wherein the power management integrated circuit divides the driving hex values into upper values corresponding to upper hex values and lower values corresponding to lower hex values, derives a result value by performing a first authentication calculation using the upper values and the lower values, generates a result hex value based on the result value, compares an authentication hex value corresponding to authentication data received from the timing controller with the result hex value, and selectively operates in a normal mode or in a protection mode based on a comparison result between the authentication hex value and the result hex value.

23. The electronic device of claim 22, wherein the timing controller and the power management integrated circuit perform an inter integrated circuit ($I^2C$) communication for performing an authentication operation between the timing controller and the power management integrated circuit.

24. The electronic device of claim 23, wherein the power management integrated circuit operates in the normal mode if the authentication hex value is consistent with the result hex value and operates in the protection mode if the authentication hex value is inconsistent with the result hex value.

25. The electronic device of claim 23, wherein the power management integrated circuit operates in the normal mode if the authentication hex value is consistent with the result hex value and operates in the protection mode if the authentication hex value is not received from the timing controller within a preset time.

26. The electronic device of claim 22, wherein the timing controller determines the driving set data based on image data input in each image frame, divides the driving hex values corresponding to the driving set data into the upper values and the lower values, derives an authentication value by performing a second authentication calculation using the upper values and the lower values, generates the authentication hex value based on the authentication value, and transmits the authentication hex value to the power management integrated circuit.

27. The electronic device of claim 26, wherein the upper values and the lower values are used as variables in a first authentication formula which the first authentication calculation is based on.

28. The electronic device of claim 27, wherein the upper values and the lower values are used as variables in a second authentication formula which the second authentication calculation is based on.

29. The electronic device of claim 28, wherein the power management integrated circuit has an exclusive access to the first authentication formula that the timing controller does not have, and the timing controller has an exclusive access to the second authentication formula that the power management integrated circuit does not have.

30. The electronic device of claim 29, wherein the authentication hex value is consistent with the result hex value if the first authentication formula is same as the second authentication formula, and the authentication hex value is inconsistent with the result hex value if the first authentication formula is different from the second authentication formula.

* * * * *